US007173374B2

(12) United States Patent
Yoo

(10) Patent No.: US 7,173,374 B2
(45) Date of Patent: Feb. 6, 2007

(54) PLASMA DISPLAY APPARATUS WITH DIFFERING SIZE PROTRUSION ELECTRODES

(75) Inventor: Sung-Hune Yoo, Ahsan-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 176 days.

(21) Appl. No.: 10/803,380

(22) Filed: Mar. 18, 2004

(65) Prior Publication Data

US 2004/0251847 A1 Dec. 16, 2004

(30) Foreign Application Priority Data

Mar. 18, 2003 (KR) ..... 10-2003-0016855

(51) Int. Cl.
*H01J 17/49* (2006.01)
*G09G 3/28* (2006.01)

(52) U.S. Cl. ..... 313/583; 313/582; 313/585; 345/60

(58) Field of Classification Search ..... 313/583, 313/585; 345/60
See application file for complete search history.

(56) References Cited

U.S. PATENT DOCUMENTS 6,157,128 A * 12/2000 Namiki et al. ..... 313/581
6,501,221 B1 * 12/2002 Kim et al. ..... 313/583
6,713,960 B2 * 3/2004 Hirose ..... 313/583
2001/0005189 A1 * 6/2001 Nunomura ..... 345/60
2001/0040539 A1 * 11/2001 Hashimoto ..... 345/60
2001/0050533 A1 * 12/2001 Hirose ..... 313/583
2002/0015012 A1 * 2/2002 Nakamura ..... 345/60
2002/0024303 A1 * 2/2002 Sano et al. ..... 313/582
2002/0063524 A1 * 5/2002 Nakamura et al. ..... 313/582
2004/0100195 A1 * 5/2004 Tsai et al. ..... 313/584
2004/0201350 A1 * 10/2004 Kwon et al. ..... 313/582
2005/0242727 A1 * 11/2005 Hur et al. ..... 313/582
2005/0253783 A1 * 11/2005 Park ..... 345/60

* cited by examiner

*Primary Examiner*—Nimeshkumar D. Patel
*Assistant Examiner*—Peter Macchiarolo
(74) *Attorney, Agent, or Firm*—Christie, Parker & Hale, LLP

(57) ABSTRACT

In a PDP apparatus a first protrusion is formed in the column direction at a scan electrode. A second protrusion is formed in the column direction at a sustain electrode. The first and second protrusions face each other with a protrusion gap therebetween. An area of the first protrusion is greater than that of the second protrusion. A first sustain pulse is applied to the scan electrode and a second sustain pulse is applied to the sustain electrode in a sustain interval. In an exemplary embodiment a first interval during which a voltage of the first sustain pulse is less than that of the second sustain pulse is longer than a second interval during which a voltage of the first sustain pulse is greater than that of the second sustain pulse.

8 Claims, 6 Drawing Sheets

PLASMA DISPLAY APPARATUS WITH DIFFERING SIZE PROTRUSION ELECTRODES

CROSS REFERENCE TO RELATED APPLICATION

This application claims priority to and the benefit of Korea Patent Application No. 2003-16855 filed on Mar. 18, 2003 in the Korean Intellectual Property Office, the entire content of which is incorporated herein by reference.

BACKGROUND OF THE INVENTION (a) Field of the Invention

The present invention relates to a plasma display panel (PDP) apparatus and a driving method thereof.

(b) Description of the Related Art

The PDP is a flat panel display that uses plasma generated by gas discharge to display characters or images and includes, according to its size, more than several scores to millions of pixels arranged in a matrix pattern.

Scan electrodes and sustain electrodes are formed in parallel on one side of the PDP, and address electrodes crossing them are formed on another side thereof. The sustain electrodes are formed corresponding to the respective scan electrodes, and ends of the sustain electrodes are coupled in common.

The method for driving the AC PDP includes a reset period, an addressing period, a sustain period, and an erase period, in temporal sequence.

The reset period is for initiating the status of each cell so as to facilitate the addressing operation. The addressing period is for selecting turn-on/off cells and applying an address voltage to the turn-on cells (i.e., addressed cells) to accumulate wall charges. The sustain period is for applying sustain pulses and causing a sustain for displaying an image on the addressed cells. The erase period is for reducing the wall charges of the cells to terminate the sustain.

A general PDP pixel has red (R), green (G), and blue (B) discharge cells. An address electrode is provided in a single discharge cell, and protrusions of the scan electrode and the sustain electrode face each other with a predetermined protrusion gap therebetween. A discharge cell is selected by an address pulse applied to an address electrode and a scan pulse applied to a scan pulse in an address interval. A discharge cell selected in the address interval is discharged by sustain pulses respectively applied to a scan electrode and a sustain electrode in a sustain interval.

Regarding a discharge phenomenon in the sustain interval, light emission at cathodes of scan and sustain electrodes is greater that at anodes thereof as shown in FIG. 1. Since the size of the cathode that manifests ⅔ of the total emission is the same as that of the anode in the prior art, an area for diffusing a discharge at a cathode is reduced, and the luminance is accordingly lost.

SUMMARY OF THE INVENTION

In one exemplary embodiment of the present invention, there is provided a PDP apparatus for diffusing a discharge of a cathode that substantially manifests ⅔ of the total light emission.

In an exemplary embodiment of the present invention is provided a PDP apparatus which includes a first substrate. A plurality of first electrodes is provided in the row direction on the first substrate. A plurality of second electrodes is provided in the row direction on the first substrate, formed between two adjacent first electrodes. The first electrode and the second electrode face each other with a predetermined electrode gap therebetween. A sustain discharge is generated by a potential difference between the first electrode and the second electrode. An area of the first electrode is larger than that of the second electrode.

In another exemplary embodiment, the first electrode has a first protrusion formed in the column direction. The second electrode has a second protrusion formed in the column direction. The first protrusion and the second protrusion face each other with the predetermined protrusion gap therebetween. An area of the first protrusion is larger than that of the second protrusion.

In yet another exemplary embodiment, a column-directional length of the first protrusion is longer than a column-directional length of the second protrusion.

In still another exemplary embodiment, a row-directional width of the first protrusion is greater than a row-directional width of the second protrusion.

In a further exemplary embodiment, the PDP further includes a second substrate facing the first substrate with a substrate gap therebetween. A plurality of third electrodes is provided in the column direction on the second substrate, wherein an address discharge is generated by a potential difference between the third and first electrodes.

In a yet further exemplary embodiment, a first sustain pulse is applied to the first electrode and a second sustain pulse is applied to the second electrode in the sustain interval. A voltage of the first sustain pulse is less than a voltage of the second sustain pulse in a first interval. A voltage of the first sustain pulse is greater than a voltage of the second sustain pulse in a first interval. A voltage of the second sustain pulse in the second interval is less than a voltage obtained by subtracting a minimum voltage for generating a sustain from the voltage of the first sustain pulse.

In another exemplary embodiment of the present invention is provided a method for driving a PDP apparatus. A first electrode and a second electrode are formed in parallel on a first substrate. An address electrode crossing the first and second electrodes is formed on a second substrate. The PDP apparatus generates an address according to a potential difference between the first electrode and the address electrode. The method includes, in a sustain interval, applying a first sustain pulse with a first voltage to the first electrode. A second sustain pulse is applied with a second voltage less than the first voltage to the second electrode to generate a sustain. A first sustain pulse is applied with a third voltage to the first electrode. A second sustain pulse is applied with a fourth voltage greater than the third voltage to the second electrode to generate a sustain, wherein the first and second electrodes face each other with a predetermined electrode gap therebetween. The first electrode has an area greater than that of the second electrode.

In yet another exemplary embodiment, the second voltage is less than a voltage obtained by subtracting a minimum voltage for generating a sustain from the first voltage.

In still another exemplary embodiment, an interval during which the first sustain pulse has the third voltage is longer than an interval during which the first sustain pulse has the first voltage.

In a further exemplary embodiment, the first and second electrodes respectively have protrusions, and the protrusion of the first electrode has an area wider than that of the protrusion of the second electrode.

DETAILED DESCRIPTION

Figure 2:
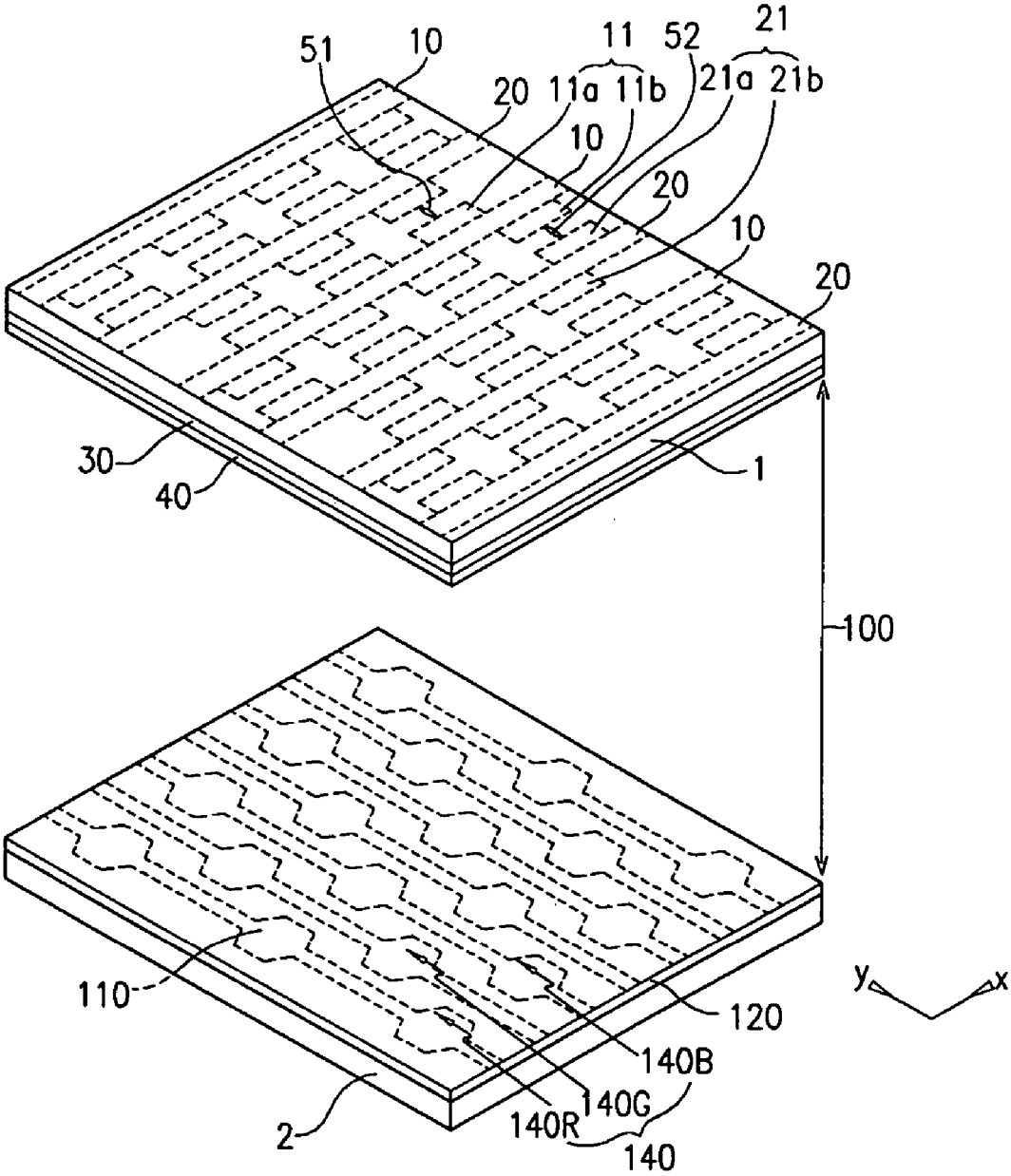
FIG. 2 shows a simplified perspective view of a PDP apparatus according to an exemplary embodiment of the present invention.
Figure 3A:
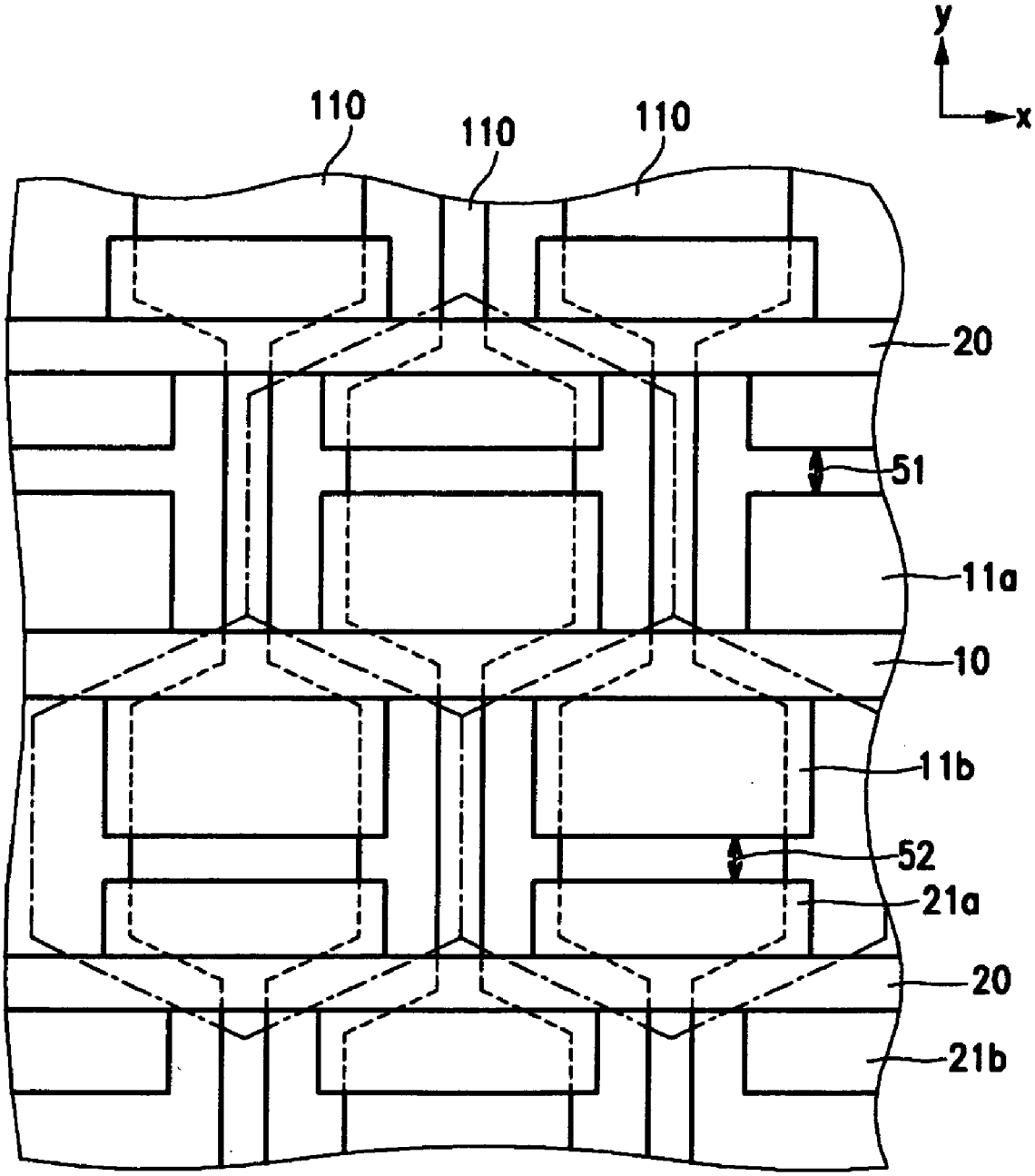
FIGS. 3A and 3B show a configuration of an electrode of a PDP according to exemplary embodiments of the present invention.
Figure 3B:
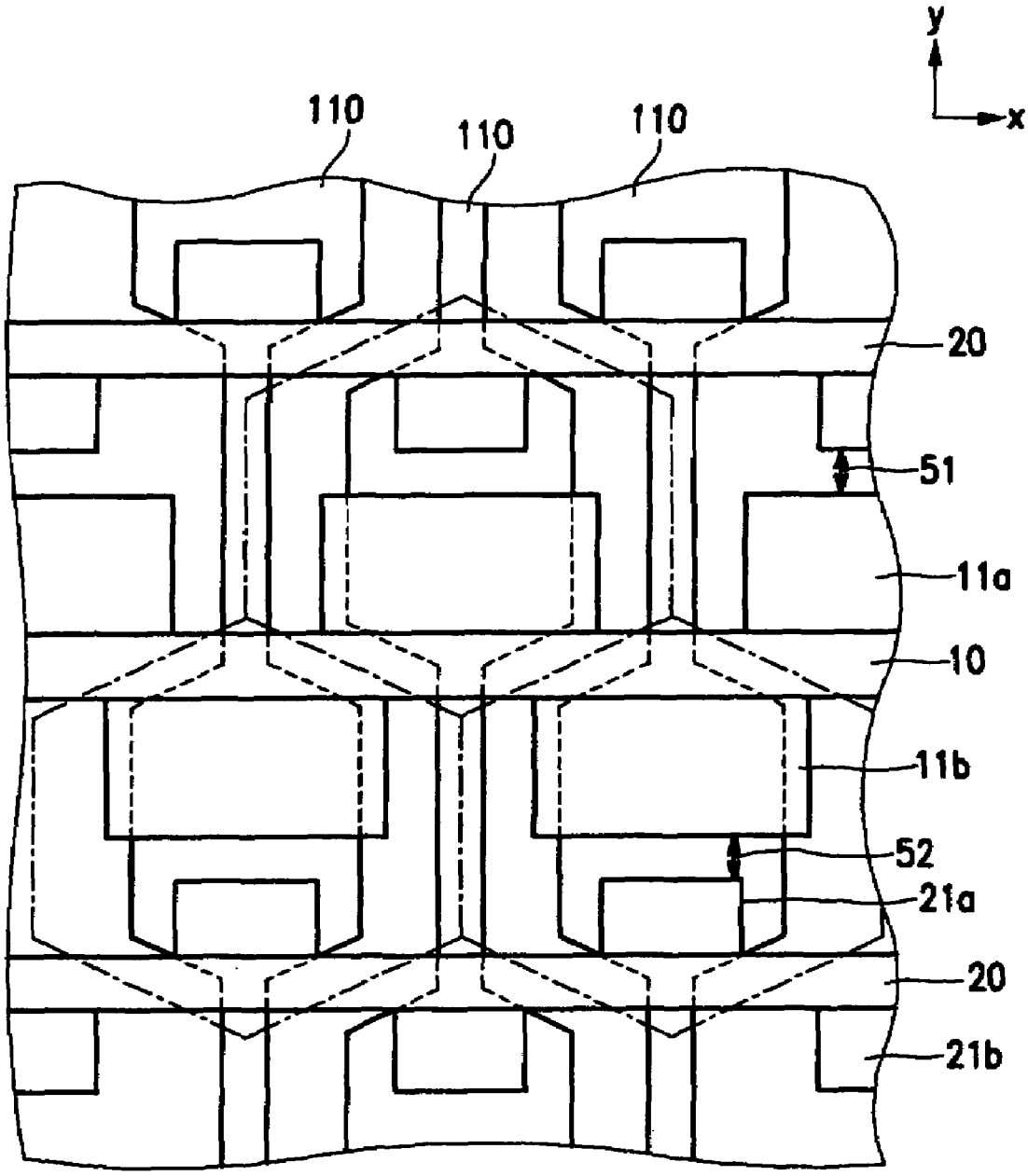

As shown in FIGS. 2, 3A and 3B, the PDP includes two substrates 1 and 2 facing each other with a predetermined substrate gap 100 therebetween. A plurality of scan electrodes (Y electrodes) 10 and a plurality of sustain electrodes (X electrodes) 20 are alternately provided in the row direction on substrate 1. Protrusions 11 (11*a* and 11*b*) are respectively formed on the top and the bottom of scan electrode 10, and protrusions 21 (21*a* and 21*b*) are respectively formed on the top and the bottom of sustain electrode 20. Protrusions 11 and 21 of scan and sustain electrodes 10 and 20 operate for a discharge. Top protrusion 11*a* of scan electrode 10 and bottom protrusion 21*b* of sustain electrode 20 face each other with a predetermined protrusion gap 51 therebetween, and bottom protrusion 11*b* of scan electrode 10 and top protrusion 21*a* of sustain electrode 20 face each other with a predetermined protrusion gap 52 therebetween. Protrusions 11 and 21 are made of a transparent dielectric material including ITO (indium tin oxide). Transparent dielectric layer 30 and protection layer 40 are formed on scan and sustain electrodes 10 and 20 and protrusions 11 and 21 to cover substrate 1.

A plurality of address electrodes 110 covered with dielectric layer 120 is formed in the column direction on substrate 2. A space determined by address electrode 110 and adjacent scan and sustain electrodes 10 and 20 forms a discharge cell. Address electrodes 110 formed at protrusions 11 and 21 of scan electrodes 10 and 20 can have a wide width for easy discharge.

A barrier rib (not illustrated) can be formed on dielectric layer 120 to partition the discharge cell, which is referred to as a closed structure. Further, the barrier rib may not be formed, or part of the barrier rib in the closed structure can be removed.

Referring to FIGS. 2, 3A and 3B, top and bottom protrusions 11*a* and 11*b* of scan electrode 10 are alternately formed, and top and bottom protrusions 21*a* and 21*b* of sustain electrode 20 are alternately formed. R, G, and B phosphors are applied to three discharge cells that are adjacent in a triangular format, and R, G, and B discharge cells 140R, 140G, and 140B form single pixel 140, which is referred to as a delta structure. In addition, top protrusions 11*a* and 21*a* and bottom protrusions 11*b* and 21*b* can be provided in the column direction and in parallel. R, G, and B phosphors are applied to three discharge cells that are adjacent in the row direction, and the R, G, and B discharge cells form a single pixel, which is referred to as a stripe structure.

Figure 1:
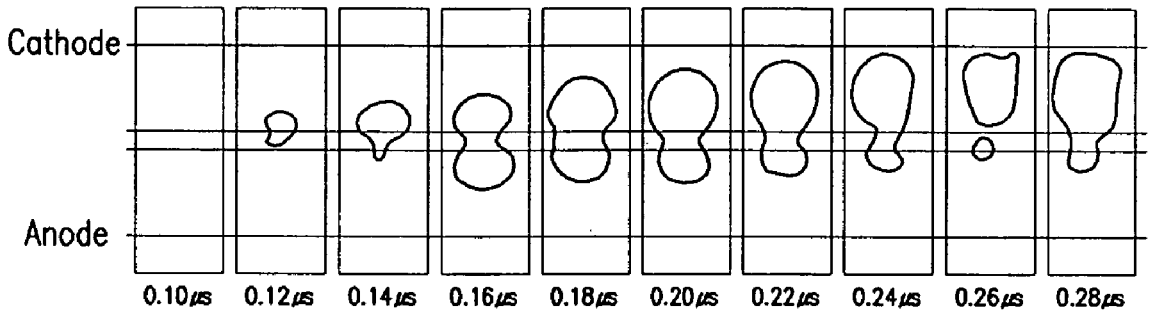
FIG. 1 shows a discharge phenomenon at scan and sustain electrodes of a PDP.

As shown in FIGS. 2 and 3A, a column-directional length of protrusion 11 formed at scan electrode 10 is longer than a column-directional length of protrusion 21 formed at sustain electrode 20. Address discharges occur between address electrodes 110 and scan electrodes 10 in the address interval. In the first exemplary embodiment, an area where address and scan electrodes 110 and 10 face each other increases to stably generate an address discharge. As shown in FIG. 1, substantially ⅔ of the total light emission is generated at the cathode in the sustain interval. Therefore, when a voltage applied to scan electrode 10 is less than a voltage applied to sustain electrode 20 in the sustain interval, that is, when scan electrode 10 operates as a cathode with respect to sustain electrode 20, light emission is more effectively performed because the length of protrusion 11 of scan electrode 10 is long.

The column-directional length of protrusion 11 of scan electrode 10 is increased in the exemplary embodiment, and further, a width of protrusion 11 can be greater than that of protrusion 22 of sustain electrode 20 (FIG. 3B), and an area of protrusion 11 can be greater than that of protrusion 21.

Figure 4:
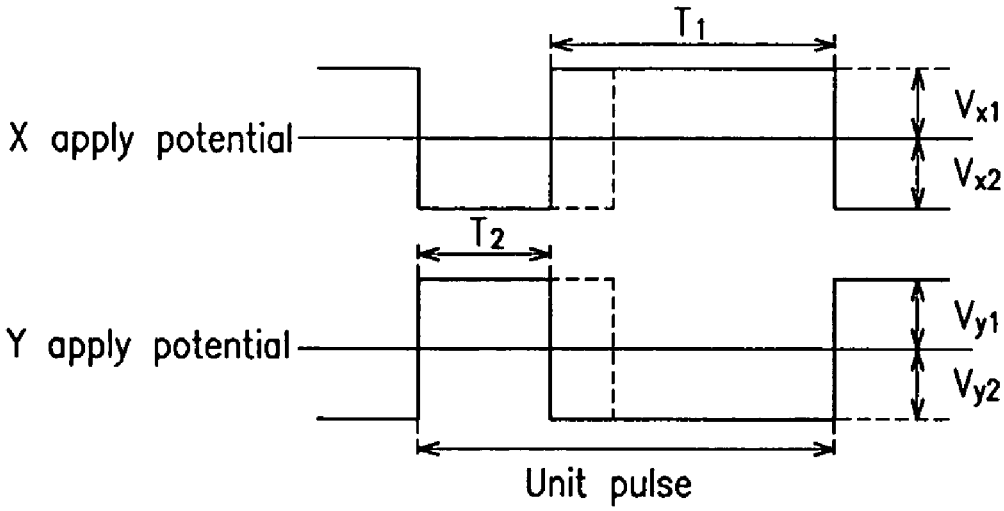
FIGS. 4 through 7 show PDP drive waveforms according to first through fourth exemplary embodiments of the present invention.

In addition, when scan electrode 10 operates as a cathode, a sustain pulse, such as that depicted in FIG. 4, can be applied to scan electrodes 10 and sustain electrodes 20 so as to maintain a sufficient discharge time.

Referring still to FIG. 4, a PDP apparatus drive method according to the first exemplary embodiment of the present invention will now be described. In the first embodiment, it is assumed that a sustain pulse alternately having voltages Vs/2 and −Vs/2 is applied to scan electrodes 10 and sustain electrodes 10 20 so that a potential difference of two electrodes 10 and 20 may be voltage Vs in the sustain interval, voltage Vs being a voltage for allowing the generation of a sustain discharge. It is also possible to apply another type of a pulse that causes the potential difference of two electrodes 10 and 20 to be voltage Vs, which will be applicable to the first through fourth exemplary embodiments.

FIG. 4 shows a PDP apparatus drive waveform according to the first exemplary embodiment of the present invention. Negative voltage Vy2 is applied to scan electrode 10 and positive voltage Vx1 is applied to sustain electrode 20 in interval T1 of a single sustain pulse in the sustain interval. Since scan electrode 10 with a long protrusion compared to that of sustain electrode 20 in interval T1 operates as a cathode, a discharge diffusion time at protrusion 11 of scan electrode 10 increases to increase the luminance. In this instance, interval T1 for applying a negative voltage to scan electrode 10 is lengthened so as to maintain voltages Vy2 and Vx1 applied to scan electrodes 10 and sustain electrodes 20 while maintaining the discharge. Interval T2 for applying negative voltage Vx2 to sustain electrode 20 is reduced by the increment of interval T1 so as to maintain a total number of sustain pulses in the sustain interval.

In the first embodiment, the length of protrusion 11 of scan electrode 10 is established to be longer than that of protrusion 21 of sustain electrode 20, and the interval for applying a negative voltage to scan electrode 10 is set to be longer than that for applying a negative voltage to sustain electrode 20. As a result, the area of protrusion 11 of scan electrode 10 becomes greater to improve address discharge efficiency during the address interval, and an interval for applying a negative voltage to scan electrode 10 increases to increase the luminance.

Figure 5:
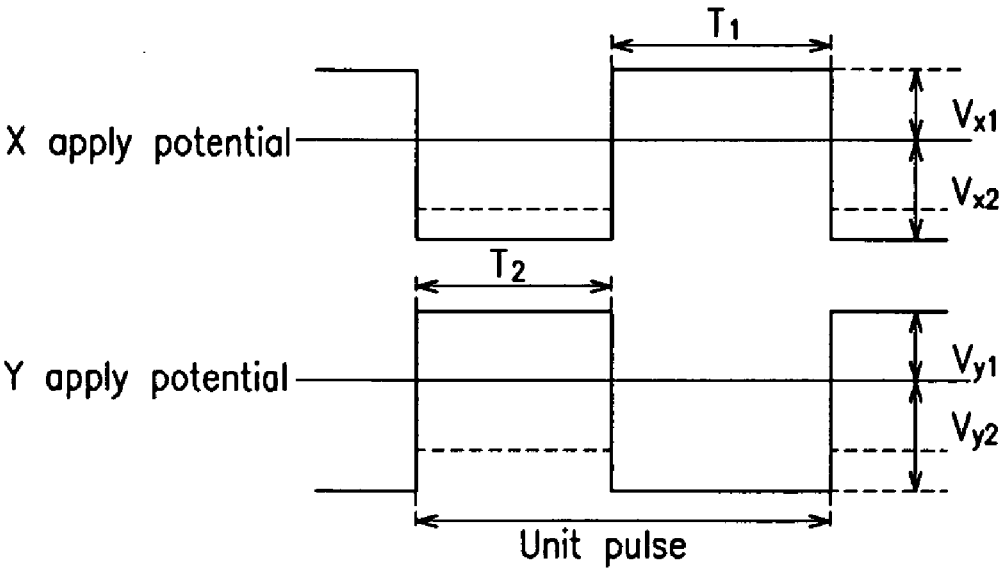
Figure 6:
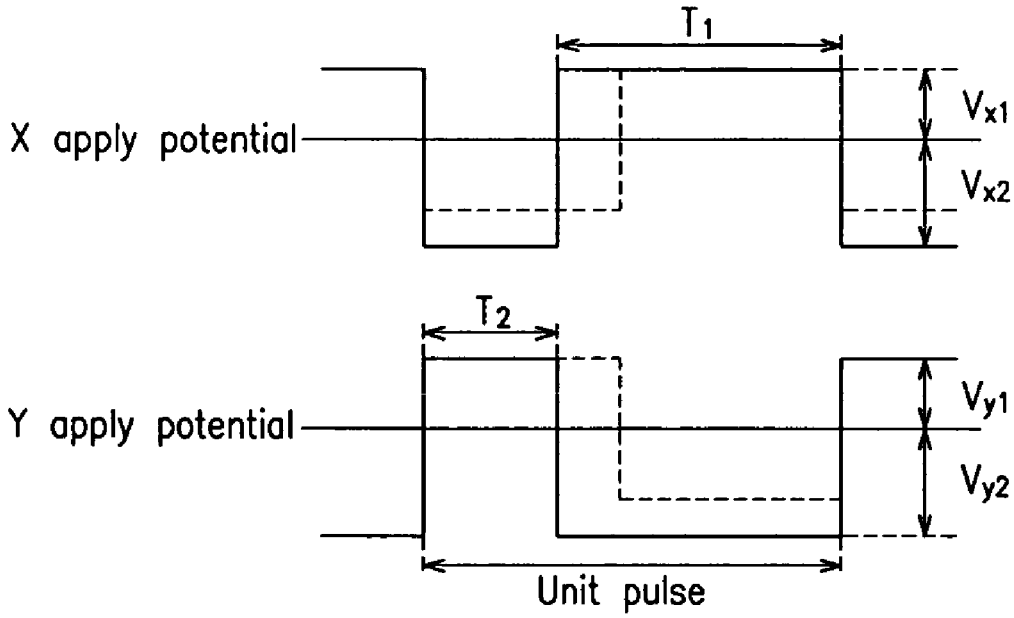
Figure 7:
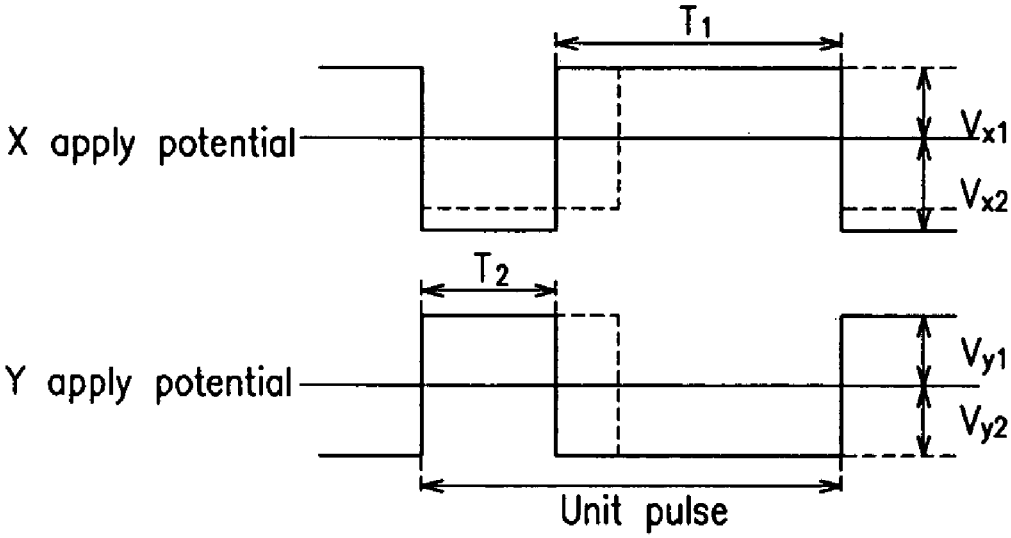

However, since the length of protrusion 21 is short in interval T2 during which sustain electrode 20 operates as a cathode, the discharge diffusion time shortens, and hence, the luminance can be reduced in interval T2. With reference to FIGS. 5 through 7, methods for compensating for the luminance in interval T2 during which sustain electrode 20 operates as a cathode will now be described.

FIGS. 5 through 7 show PDP drive waveforms according to second through fourth exemplary embodiments of the present invention.

Referring to FIG. 5, levels of negative voltages Vx2 and Vy2 are lowered in the sustain pulse according to the second embodiment compared to the sustain pulse of FIG. 4. That is, intensities of negative voltages Vx2 and Vy2 are made greater than those of positive voltages Vx1 and Vy1, and are applied to sustain and scan electrodes 20 and 10. Accordingly, when negative voltage Vx2 is applied to sustain electrode 20 in interval T2, a potential difference between sustain electrode 20 and scan electrode 10 and a potential difference between address electrode 110 and sustain electrode 20 are increased to improve the luminance. That is, when sustain electrode 20 operates as a cathode in interval T2, shortened protrusion 21 of sustain electrode 20 can be compensated by increasing the potential difference between scan electrode 10 and sustain electrode 20, and since the intensity of negative voltage Vy1 of scan electrode 10 is also increased, the luminance is further improved when scan electrode 10 operates as a cathode.

The intensity of the negative voltage applied to scan electrode 10 is increased in the second embodiment, and differing from this, a pulse (i.e., a pulse shown as a dotted line in FIG. 5) corresponding to the existing sustain pulse can be applied to scan electrode 10.

In the sustain pulse according to the third embodiment, referring to FIG. 6, levels of negative voltages Vx2 and Vy2 of the sustain pulse of FIG. 4 are lowered in the like manner of the second embodiment. Interval T1 for applying a negative voltage to scan electrode 10 is lengthened, and interval T2 for applying a negative voltage to sustain electrode 20 is shortened. As a result, the discharge diffusion time is lengthened by the length of protrusion 11 of scan electrode 10 in interval T1 during which scan electrode 10 is a cathode to thereby increase the luminance, and since interval T1 is long, the applied voltage is maintained during the discharge diffusion time. In interval T2 during which sustain electrode 20 is a cathode, since negative voltage Vx2 applied to sustain electrode 20 has been greatly increased, the potential difference between sustain electrode 20 and scan electrode 10 and the potential difference between sustain electrode 20 and address electrode 110 increase to activate the discharge and improve the luminance.

Referring to FIG. 7, in the sustain pulse according to the fourth embodiment, the negative voltage applied to scan electrode 10 corresponds to the existing sustain pulse, differing from the third embodiment. That is, a time for applying negative voltage Vy2 is increased to maintain the discharge when scan electrode 10 becomes a cathode, and negative voltage Vx2 is increased to compensate for the luminance reduction when sustain electrode 20 becomes a cathode.

According to the present invention, an address discharge can be effectively generated because of the large size of the protrusion of the scan electrode. The discharge is maintained for a long time since the time for applying a negative voltage to the scan electrode is long. Also, the size of the protrusion of the sustain electrode is decreased to compensate for the reduced luminance since the negative voltage applied to the sustain electrode is large.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

What is claimed is:

1. A plasma display panel apparatus comprising:

a first substrate;

a plurality of first electrodes provided in a row direction on the first substrate; and a plurality of second electrodes provided in the row direction on the first substrate, at least one of said plurality of second electrodes being formed between two adjacent first electrodes, defining first discharge cells with one of the two adjacent first electrodes, and further defining second discharge cells with the other of the two adjacent first electrodes, at least one of said plurality of first electrodes being formed between two adjacent second electrodes, wherein:

the at least one of said plurality of first electrodes and the at least one of said plurality of second electrodes face each other with a predetermined electrode gap therebetween;

a sustain discharge is generated by a voltage potential difference between the at least one of said plurality of first electrodes and the at least one of said pluraliyt of second electrodes; and an area of the at least one of said plurality of first electrodes is larger than that of the at least one of said plurality of second electrodes.

2. The plasma display apparatus of claim 1, wherein:

the at least one of said plurality of first electrodes has a first protrusion formed in a column direction;

the at least one of said plurality of second electrodes has a second protrusion formed in the column direction;

the first protrusion and the second protrusion face each other with the predetermined protrusion gap therebetween; and an area of the first protrusion is larger than that of the second protrusion.

3. The plasma display apparatus of claim 2, wherein a column-directional length of the first protrusion is longer than a column-directional length of the second protrusion.

4. The plasma display apparatus of claim 2, wherein a row-directional width of the first protrusion is longer than a row-directional width of the second protrusion.

5. The plasma display apparatus of claim 1, further comprising:

a second substrate facing the first substrate with a substrate gap therebetween; and a plurality of third electrodes provided in the column direction on the second substrate, wherein an address discharge is generated by a potential difference between at least one of said plurality of third electrodes and the at least one of said plurality of first electrodes.

6. The plasma display apparatus of claim 1, wherein:

a first sustain pulse is applied to the at least one of said plurality of first electrodes and a second sustain pulse is applied to the at least one of said plurality of second electrodes in the sustain interval;

a voltage of the first sustain pulse is less than a voltage of the second sustain pulse in a first interval;

a voltage of the first sustain pulse is greater than a voltage of the second sustain pulse in a first interval; and a voltage of the second sustain pulse in the second interval is less than a voltage obtained by subtracting a minimum voltage for generating a sustain from the voltage of the first sustain pulse.

7. The plasma display apparatus of claim 1, wherein:

a first sustain pulse is applied to the at least one of said plurality of first electrodes and a second sustain pulse is applied to the at least one of said plurality of second electrodes in the sustain interval; and a first interval during which a voltage of the first sustain pulse is less than a voltage of the second sustain pulse is longer than a second interval during which a voltage of the first sustain pulse is greater than a voltage of the second sustain pulse.

8. The plasma display apparatus of claim 7, wherein a voltage of the second sustain pulse in the second interval is less than a voltage obtained by subtracting a minimum voltage for generating a sustain from the voltage of the first sustain pulse.

* * * * *